US009696015B2

(12) United States Patent
Menke, III et al.

(10) Patent No.: US 9,696,015 B2
(45) Date of Patent: Jul. 4, 2017

(54) CHANGEABLE EMERGENCY WARNING LIGHT ASSEMBLY

(71) Applicant: PowerArc, Inc., St. Louis, MO (US)

(72) Inventors: W. Kenneth Menke, III, St. Louis, MO (US); Dale W. Sass, Gardner, KS (US)

(73) Assignee: PowerArc, Inc., St. Louis, MO (US)

( * ) Notice: Subject to any disclaimer, the term of this patent is extended or adjusted under 35 U.S.C. 154(b) by 519 days.

(21) Appl. No.: 14/338,701

(22) Filed: Jul. 23, 2014

(65) Prior Publication Data

US 2016/0025306 A1 Jan. 28, 2016

(51) Int. Cl.

| | |
|---|---|
| ***F21V 17/00*** | (2006.01) |
| ***F21V 15/01*** | (2006.01) |
| ***F21V 5/00*** | (2015.01) |
| ***G08B 7/06*** | (2006.01) |
| *F21V 5/04* | (2006.01) |
| *F21Y 115/10* | (2016.01) |

(52) U.S. Cl.

CPC ..... *F21V 17/002* (2013.01); *F21V 5/00* (2013.01); *G08B 7/062* (2013.01); *F21V 5/04* (2013.01); *F21V 15/01* (2013.01); *F21Y 2115/10* (2016.08)

(58) Field of Classification Search

CPC . F21V 5/00; F21V 5/04; F21V 17/002; F21V 9/08; F21V 9/00; G08B 7/062

USPC ..... 362/235

See application file for complete search history.

(56) References Cited

U.S. PATENT DOCUMENTS

| | | | | |
|---|---|---|---|---|
| 3,322,946 | A | 5/1967 | Cooper | |
| 3,726,350 | A * | 4/1973 | Pessier | E21B 10/52 175/374 |
| 4,490,776 | A | 12/1984 | Kluch | |
| 4,855,877 | A * | 8/1989 | Otaka | F21S 48/2218 362/242 |
| 4,891,737 | A | 1/1990 | Szymanek | |
| 5,381,273 | A | 1/1995 | Goda | |
| 5,876,107 | A | 3/1999 | Parker et al. | |
| 5,934,798 | A * | 8/1999 | Roller | B60Q 1/56 362/230 |
| 5,993,027 | A | 11/1999 | Yamamoto et al. | |
| 6,024,468 | A | 2/2000 | Kassay et al. | |
| 6,149,283 | A | 11/2000 | Conway et al. | |
| 6,352,359 | B1 | 3/2002 | Shie et al. | |
| 6,616,299 | B2 * | 9/2003 | Martineau | F21V 5/045 362/235 |
| 6,626,560 | B1 | 9/2003 | Caferro et al. | |
| 6,705,743 | B1 * | 3/2004 | Elembaby | G09F 13/04 362/235 |
| 6,953,271 | B2 | 10/2005 | Ayniéet et al. | |
| 7,002,726 | B2 | 2/2006 | Patel et al. | |
| 7,036,957 | B2 | 5/2006 | Paravantsos | |
| 7,063,428 | B2 * | 6/2006 | Lowe | G03B 15/06 135/125 |
| 7,147,345 | B1 * | 12/2006 | Toney, Jr. | F21L 4/00 362/208 |
| 7,172,315 | B2 * | 2/2007 | Lamke | B60Q 1/2696 257/E25.028 |
| 7,177,490 | B2 | 2/2007 | Sugiyama et al. | |

(Continued)

*Primary Examiner* — Anabel Ton

(74) *Attorney, Agent, or Firm* — Joseph M. Rolnicki; Evans & Dixon, L.L.C.

(57) ABSTRACT

An emergency warning light assembly has features that enable changing a color of light emitted from the assembly and changing a beam pattern and beam intensity of light emitted from the assembly.

19 Claims, 12 Drawing Sheets

(56) References Cited

U.S. PATENT DOCUMENTS

| | | | | |
|---|---|---|---|---|
| 7,261,435 | B2 | 8/2007 | Gould et al. | |
| 7,278,768 | B2 | 10/2007 | Gasquet | |
| 7,575,344 | B2 | 8/2009 | Lin et al. | |
| 7,588,345 | B1 * | 9/2009 | Davis | F21S 8/02 362/223 |
| 7,665,862 | B2 | 2/2010 | Villard | |
| 2011/0134636 | A1 | 6/2011 | Chang et al. | |
| 2014/0240980 | A1 * | 8/2014 | Howe | F21V 3/0445 362/235 |

* cited by examiner

CHANGEABLE EMERGENCY WARNING LIGHT ASSEMBLY

FIELD

This disclosure pertains to an emergency warning light assembly having features that enable changing a color of light emitted from the assembly and changing a beam pattern and intensity of light emitted from the assembly.

BACKGROUND

The introduction of high power LEDs (light emitting diodes) in emergency warning light devices over the last decade has created a demand for constant modifications to the devices in how the light energy of an LED is harnessed to maximize light beam patterns and intensity. The typical packaging of an LED prohibits the LED alone from being omni-directional and gives the LED a limited critical angle or maximum angle of incidence. In many instances, in order to alter the beam pattern and intensity from an LED light source, it is necessary that secondary optics be used in front of the LED.

In the emergency warning light device industry it is common to place secondary optics in front of the LED according to one of three methods: (1) mold optics into an external housing of the LED light device; (2) employ independent optics over each individual LED; (3) a combination of both (1) and (2).

These three methods, though effective in controlling the beam patterns and intensity of LEDs, have limits in flexibility of design and assembly. In the first method, when molding optics into an external housing of an emergency warning light device, the shape of the optics is restricted by the particular physical parameters of the mold negative cavity being able to be separated from the mold positive cavity. Complex shapes of optics require molds with costly lifts and slides. Additionally, once the molding tool is made, simple low-cost modifications are not possible.

The molding restrictions are also present in method (2) where independent optics are placed over the LED. Placing optics over the LEDs provides flexibility in changing beam patterns or beam intensity by simply changing the individual optic, but this is again limited by the required volume needed for the optic and the types of beam patterns that can be generated.

SUMMARY

The changeable emergency light assembly of this disclosure is comprised of an external housing and a lens sheet. The housing and the lens sheet are molded of plastic. The plastic of the housing and lens sheet is translucent or transparent, enabling light to pass through both the housing and lens sheet. Additionally, the plastic of the housing and lens sheet may be colored, and may be different colors.

The housing has a base that is removably attachable to a separate light source where light from the light source illuminates an interior of the housing. On an opposite side of the housing interior from the base, the housing has first, second and third planar walls. The first and second walls are connected along a first straight line of connection and are oriented at a first angle. The second and third walls are connected along a second straight line of connection and are oriented at the first angle. The first and second lines of connection are on opposite sides of the second wall and are parallel.

The lens sheet is one of a plurality of lens sheets that are constructed in basically the same manner. Each lens sheet is interchangeably insertable and attachable to the housing in the housing interior volume. Each of the lens sheets has a first, second and third planar panel. The first and second panels are connected along a first straight line of connection and the second and third panels are connected along a second straight line of connection. In one embodiment the lines of connection are living hinges and in another embodiment the lines of connection are attachable and detachable connections between the panels. The first, second and third panels have flat exterior surfaces and opposite interior surfaces with refractive surface configurations. The refractive surface configurations of each lens sheet of the plurality of lens sheets is different from the refractive surface configurations of each of the other lens sheets of the plurality of lens sheets. Each of the lens sheets is interchangeably insertable into the housing interior volume with the exterior surface of the lens sheet first panel engaging against the interior surface of the housing first wall, the exterior surface of the lens sheet second panel engaging against the interior surface of the housing second wall, and the exterior surface of the lens sheet third panel engaging against the interior surface of the housing third wall. Additionally, the straight line of connection between the lens sheet first and second panels is positioned in a same plane as the straight line of connection between the housing first and second walls and the straight line of connection between the lens sheet second and third panels is positioned in a same plane as the straight line of connection between the housing second and third walls.

Each lens sheet is removably attachable in the housing interior using either screw bosses, over snaps, or other mechanical devices. This enables one lens sheet to be easily removed from the housing interior volume and substituted by another lens sheet in the housing interior. Substituting lens sheets in the housing interior enables changing the beam pattern and intensity of light passing through the housing and the lens sheet from a light source that has been attached to the light assembly.

Molding the lens sheet as a single, thin, flat sheet with living hinges along the straight lines of connection between the first and second panels and the second and third panels enables the panels to be bent to a plurality of different angles about the living hinges in reference to the light source. This also enables the lens sheet to be inserted into any one housing of a plurality of housings where the first, second and third walls of the housings are oriented at different angles. The flexibility of the lens sheet with its living hinges further enables the formation of more complex optic designs.

In the embodiment of the lens sheet being first, second and third panels that have been molded flat and separate and with the panels having attachable and detachable edges along their straight lines of connection, the panel edges also enable the panels to be interconnected at a plurality of different angles. This also enables the lens sheets to be assembled into housings where the first, second and third walls of the housing are positioned at different relative angles.

With the removable and interchangeable lens sheets, a single signal warning device employing the changeable light assembly can quickly be configured for different applications and functions based on the inserted lens sheet. The device could be used as a warning signal device or a combination warning signal device and ground lighting device. By simply changing the lens sheet in the housing of the emergency warning light assembly it is possible to change beam patterns and beam intensity of the assembly.

With the housing and lens sheet being molded of transparent or translucent materials of different colors, it is also possible to modify the color of light emitted through the assembly by blending. For example, it could be possible to achieve a purple light signal from the assembly using a red housing with a blue lens sheet rather than trying to mold a purple lens.

BRIEF DESCRIPTION OF THE DRAWINGS

Further features of the changeable light assembly of this disclosure are set forth in the following detailed description of the light assembly and the drawing figures.

DETAILED DESCRIPTION

Figure 1:
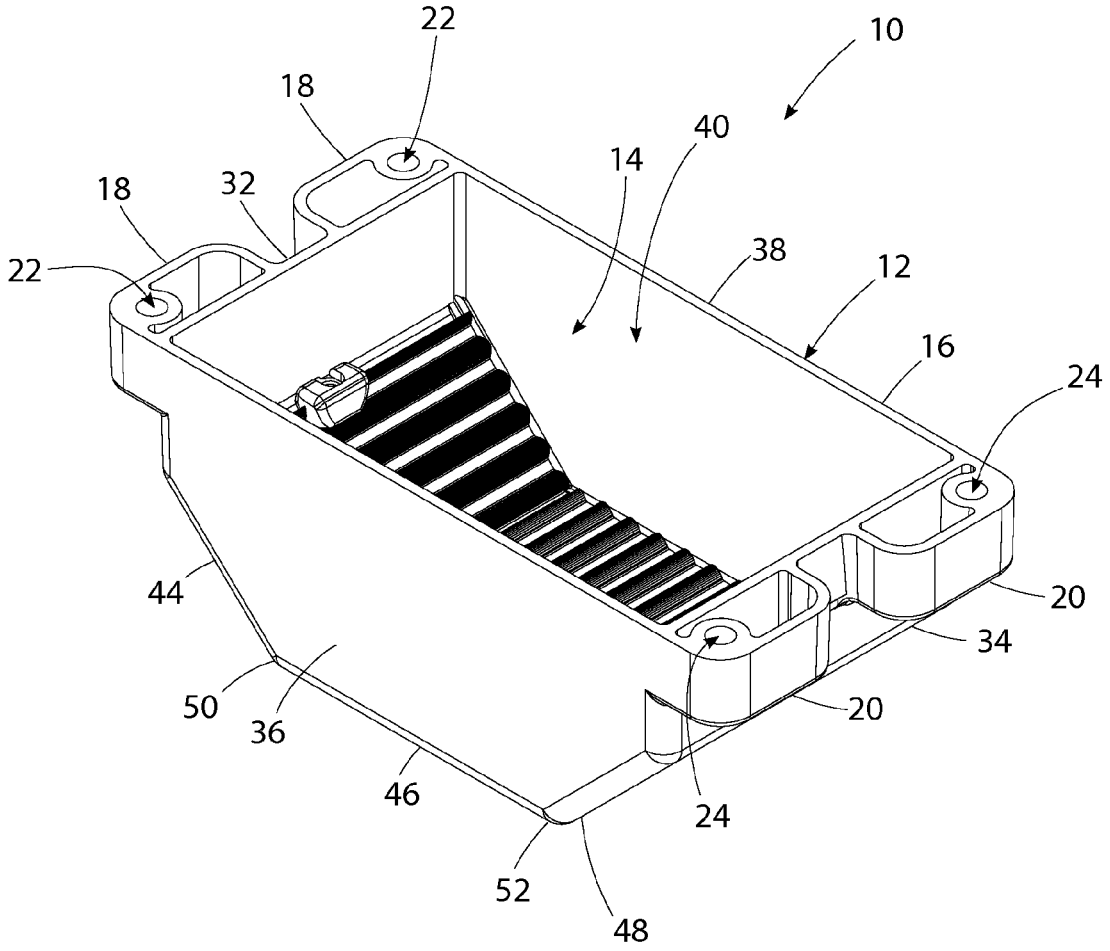
FIG. 1 is a perspective view of the changeable light assembly with a lens sheet assembled into the interior volume of the external housing.
Figure 2:
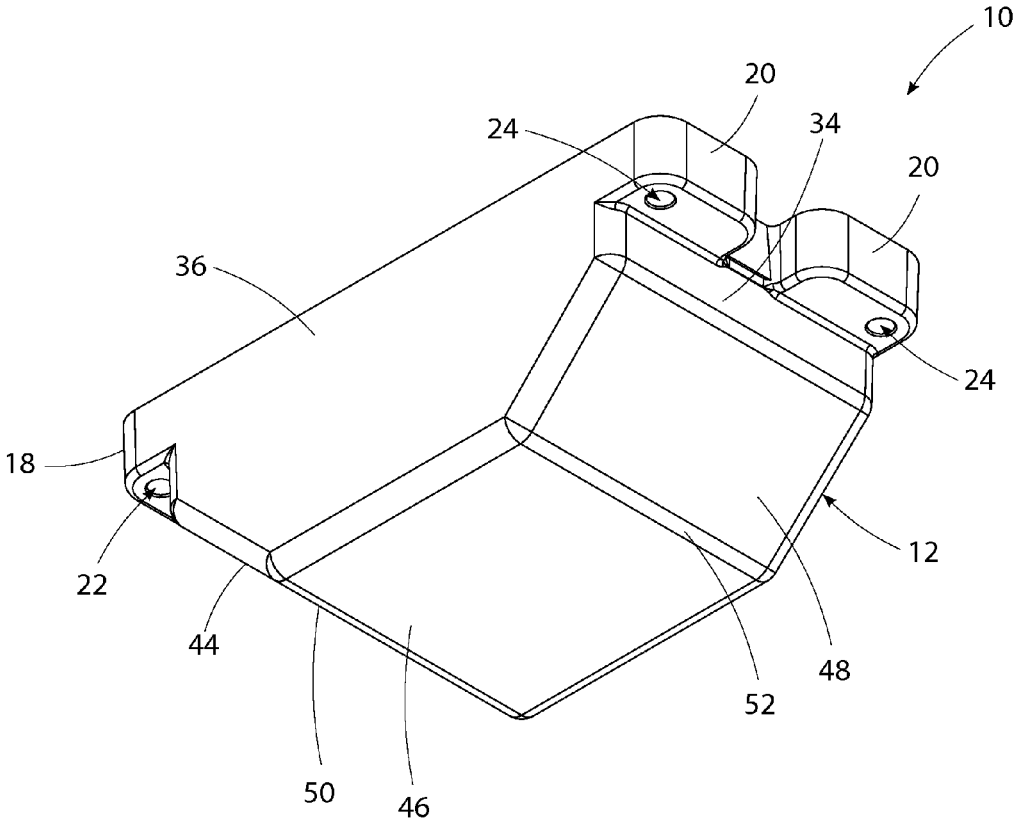
FIG. 2 is a perspective view of the opposite side of the changeable light assembly shown in FIG. 1.
Figure 3:
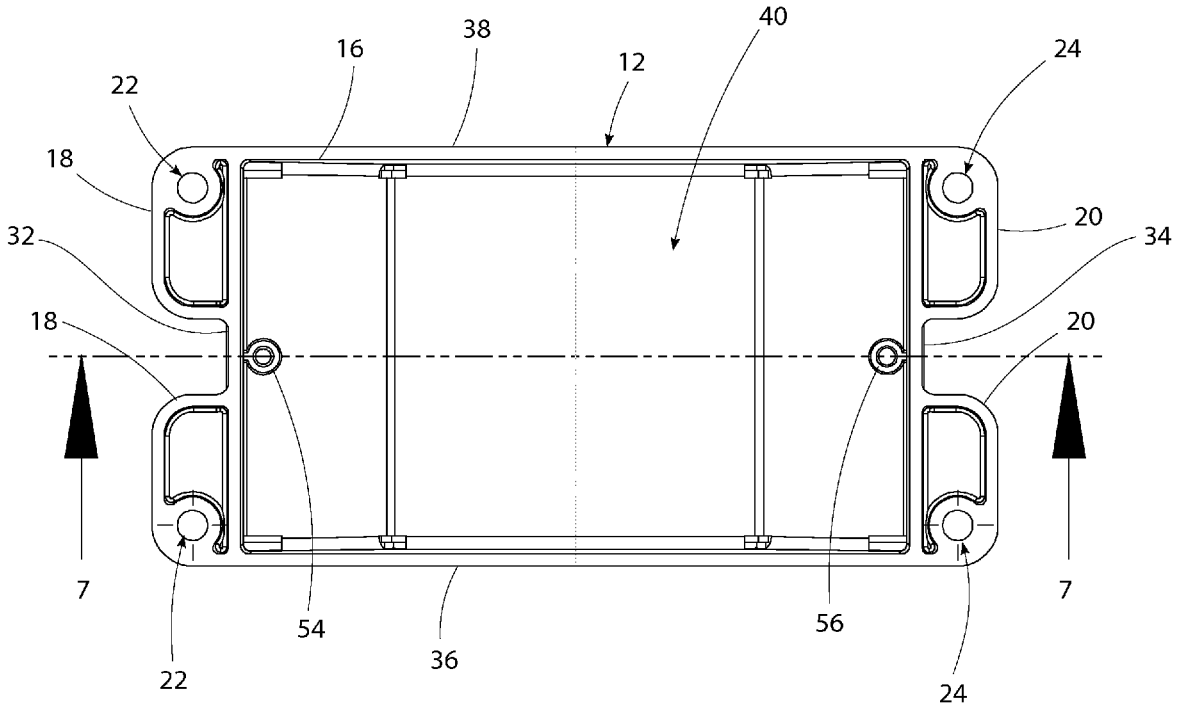
FIG. 3 is a plan view of the interior of the light assembly with the lens sheet removed.
Figure 4:
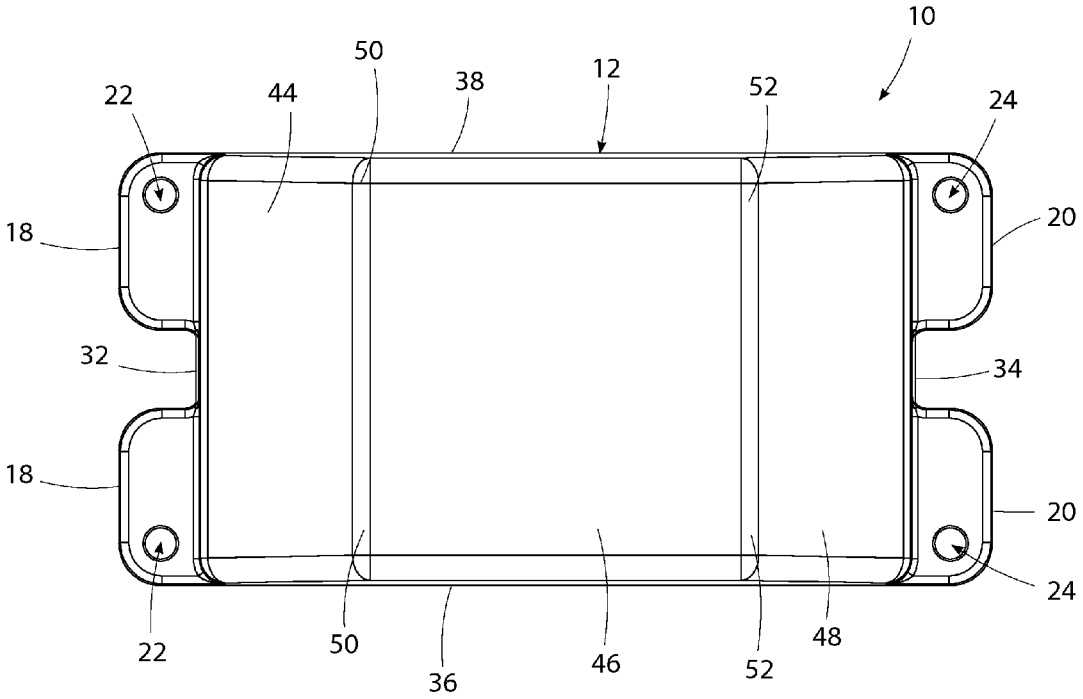
FIG. 4 is a plan view of the opposite side of the light assembly shown in FIG. 3.
Figure 5:
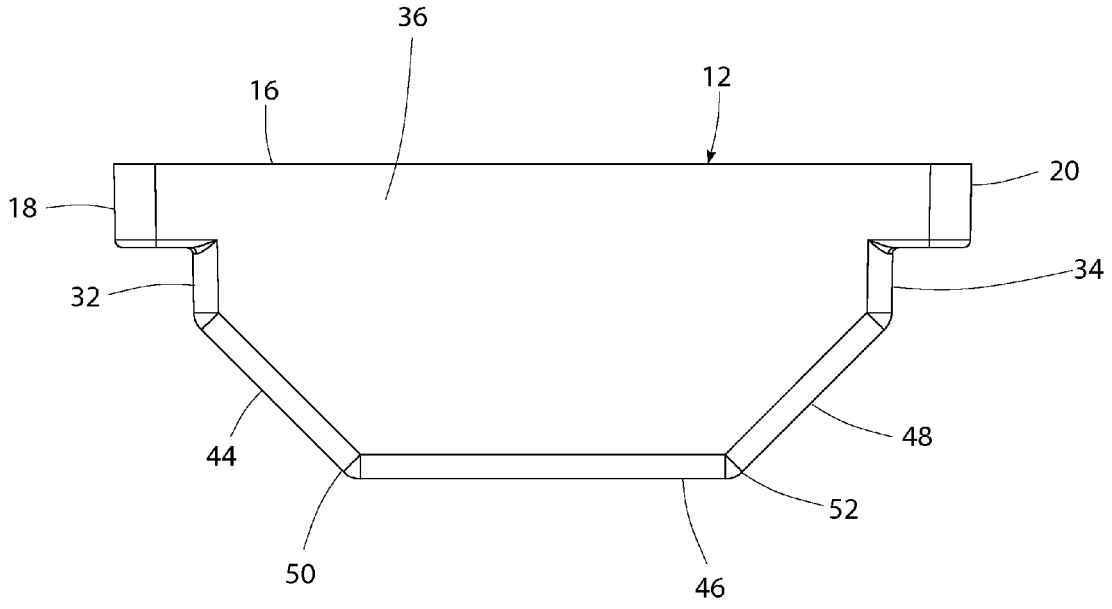
FIG. 5 is an elevation view of one side of the light assembly, with the opposite side of the light assembly being a mirror image thereof.

FIG. 1 is a representation of a perspective view of the changeable emergency light assembly 10 of this disclosure. The light assembly 10 as shown in FIG. 1 is basically comprised of an external housing 12 and one lens sheet 14 of a plurality of different lens sheets that can be assembled into the housing, as will be explained. The housing 12 and the lens sheet 14 are molded of plastic. The plastic of the housing 12 and the lens sheet 14 is translucent or transparent, enabling light to pass through both the housing and the lens sheet in use of the assembly. In other embodiments, portions of the housing 12 through which light does not pass may be molded of an opaque plastic. Additionally, the plastic of the housing 12 and the lens sheet 14 may be colored, and may be different colors. For example, the plastic of the housing 12 could be red and the plastic of the lens sheet 14 could be blue, whereby light passing through the housing and the lens sheet would blend into the color purple.

In the example of the housing shown in the drawing figures the housing 12 has a rectangular base surface 16. The base surface 16 is shaped and sized to fit over a light source with which the light assembly 10 is to be used. Thus, the base surface 16 could have different shapes and sizes depending on the shape and size of the light source to which the assembly 10 is to be attached. Two pairs of attachment shoulders 18, 20 project from opposite sides of the base surface 16. The shoulders 18, 20 have surfaces that are co-planar with the base surface 16 and fastener holes 22, 24 that receive threaded fasteners to attach the assembly 10 to the light source. Again, the shoulders 18, 20 are examples of means provided on the housing 12 for attaching the housing to a separate light source. Depending on the size and configuration of the light source with which the light assembly is to be used, the means of attaching the light assembly to the light source could be different from that shown.

The housing 12 also comprises first 32 and second 34 parallel, planar side walls on opposite sides of the base surface 16 and third 36 and fourth 38 parallel, planar side walls on opposite sides of the base surface 16. The four side walls 32, 24, 36, 38 give the base surface 16 a rectangular configuration that surrounds an opening to the housing interior volume 40. The side walls are dimensions to enable the light source to fit into the interior volume and illuminate the interior volume of the housing. Thus, the shape and size of the side walls will change depending on the configuration of the light source used with the assembly 10.

First 44, second 46 and third 48 end walls extend between the side walls of the housing. Each of the end walls 44, 46, 48 has a planar, rectangular configuration. The three end walls 44, 46, 48 are the walls of the light assembly 10 through which light will pass from the light source to which the light assembly is attached. It is therefore necessary that the end walls 44, 46, 48 be transparent or translucent. The remaining walls of the housing 12 could be formed of an opaque material. The first end wall 44 and the third end wall 48 are connected to the opposite sides of the second end wall 46 along parallel, straight lines of connection 50, 52. The first 44 and second 46 end walls are fixed at a first angle on opposite sides of a first line of connection 50 and the second 46 and third 48 end walls are fixed at the same angle on opposite sides of a second line of connection 52. In the embodiment of the housing 12 shown in the drawings each of the housing end walls 44, 46, 48 has a flat interior surface. In other embodiments of the housing the end wall interior surfaces could have other molded shapes.

A first screw boss 54 is formed in the opposite side of the first end wall 44 from its first line of connection 50 to the second end wall 46. A second screw boss 56 is formed in the opposite side of the third end wall 48 from its second line of connection 52 to the second end wall 46. The screw bosses 54, 56 are provided to removably attach the lens sheet 14 in the housing interior volume 40. Other equivalent attachment means could be used in place of the screw bosses.

Referring to FIGS. 7-10, the lens sheet 14 is shown removed from the interior volume of the housing 12. The lens sheet 14 is one of a plurality of lens sheets that are constructed in basically the same manner. Each lens sheet is interchangeably insertable and attachable to the housing in the housing interior volume. The lens sheet 14 is comprised of a first rectangular panel 62, a second rectangular panel 64 and a third rectangular panel 66. In other embodiments the lens sheet 14 could have two panels or more than three panels. The first panel 62 has a flat exterior surface 68 that is dimensioned to lay flat against and substantially cover the interior surface 70 of the housing first end wall 44. The first panel 62 is also dimensioned to lay flat against the housing first end wall 44 and extend between the housing third 36 and fourth 38 side walls. The lens sheet second panel 64 has a flat exterior surface 72 that is dimensioned to lay flat against and substantially cover the interior surface 74 of the housing second end wall 46. The second panel 64 is also dimensioned to lay flat against the housing second end wall 46 and extend between the third 36 and fourth 38 side walls of the housing. The lens sheet third panel 66 has a flat exterior surface 76 that is dimensioned to lay flat against and substantially cover the interior surface 78 of the housing third end wall 48. The third panel 66 is also dimensioned to lay flat against the housing third end wall 48 and extend between the housing third 36 and fourth 38 side walls.

The first 62 and second 64 panels are connected together along a first straight line of connection and the second 64 and third 66 panels are connected together along a second straight line of connection 82. In one embodiment, the lines of connection 80, 82 are living hinges. This enables the lens sheet 14 to be molded as a thin, flat sheet. After molding the lens sheet first panel 62 and third panel 66 can be bent relative to the second panel 64 to configure the lens sheet to fit flat against the interior surfaces of the housing first 44, second 46 and third 48 end walls. Thus, the living hinges along the lines of connection 80, 82 enable a less complicated and inexpensive mold to be used in producing the lens sheet 14. In another embodiment, the lines of connection 80, 82 are attachable and detachable interlocking connections between the panels 62, 64, 66. These enable the lens sheet panels 62, 64, 66 to be connected together at any desired relative angles between the panels.

Figure 10:
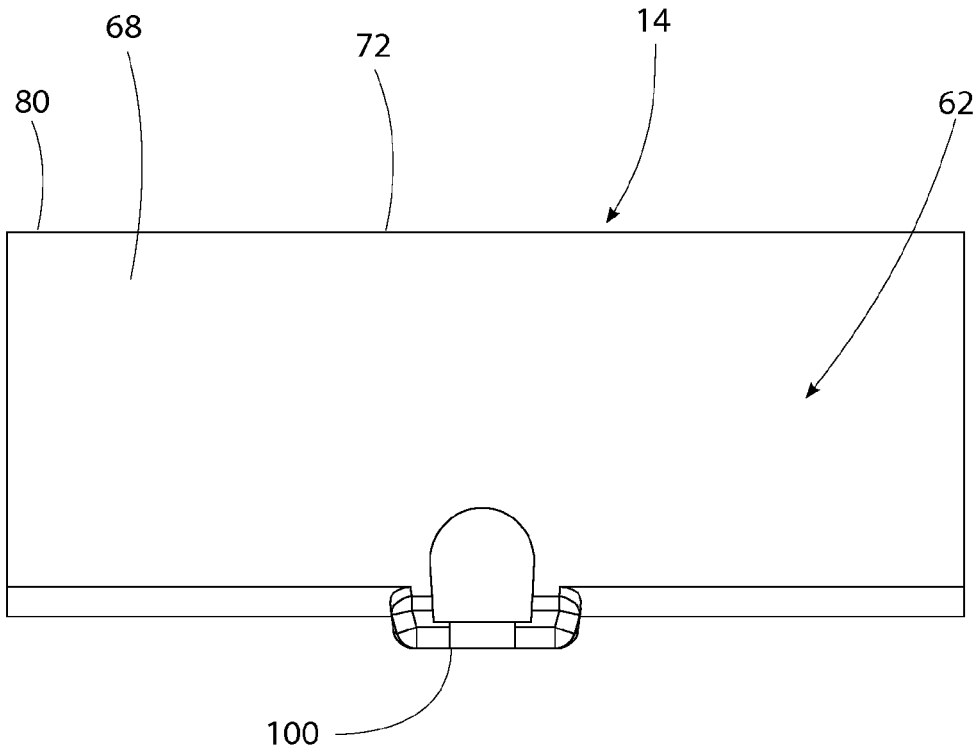
FIG. 10 is an end elevation view of the lens sheet.
Figure 11:
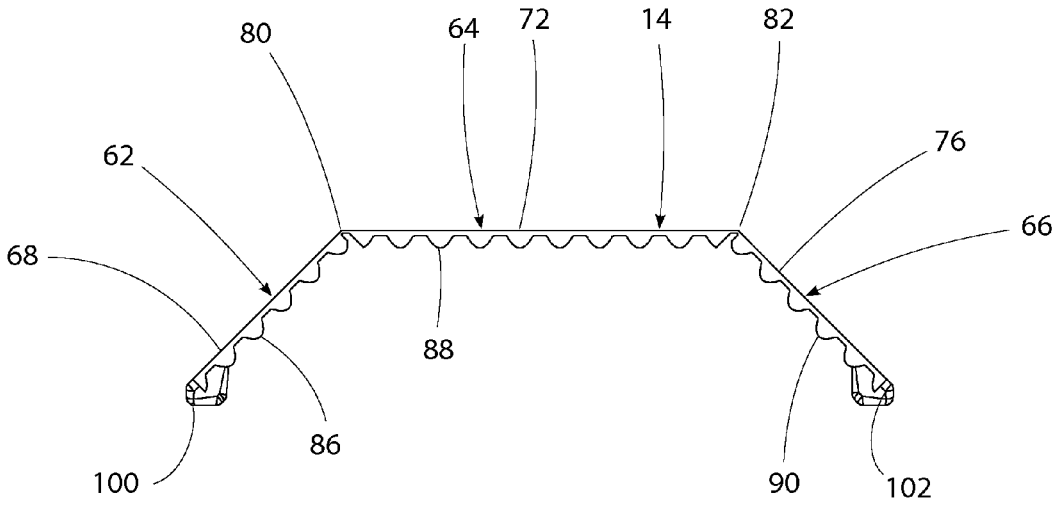
FIG. 11 is a side elevation view of the lens sheet.
Figure 12:
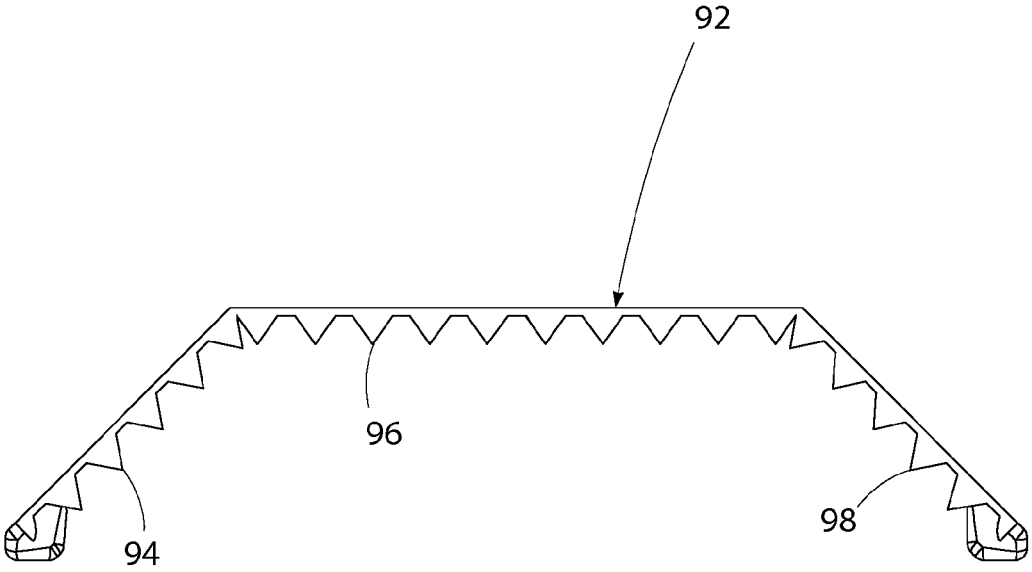
FIG. 12 is a side elevation view of a further lens sheet having a different refractive surface configuration from the lens sheet of FIG. 11.

The interior surfaces 86, 88, 90 of the three lens sheet panels 62, 64, 66 are formed with light refractive surface configurations. In the embodiment of the lens sheet shown in FIG. 10, the light refractive surface configurations of the interior surfaces 86, 88, 90 are comprised of convex curved surface ridges that extend across the widths of the panel interior surfaces 86, 88, 90. These surface configurations refract light that passes through the lens sheet. In other lens sheets of the plurality of lens sheets, the light refractive surface configurations could be different from those shown in FIG. 10. For example, FIG. 12 shows another lens sheet 92 of the plurality of lens sheets in which the panel interior surfaces 94, 96, 98 are formed as triangular surface ridges that extend across the width of the lens sheet panels. The lens sheets shown in FIGS. 10 and 12 are only two examples of the light refractive surface configurations that can be used on the lens sheets of the light assembly. The lens sheet could also have panel interior surface configurations that are different from each other. For example the two outer panels could have configurations that spread light and the center panel could have a configuration that focuses light. Depending on the desired direction and intensity of light to be emitted from the light assembly 10, a lens sheet from a plurality of different lens sheets can be assembled in the exterior housing 12 to achieve any desired result.

Figure 6:
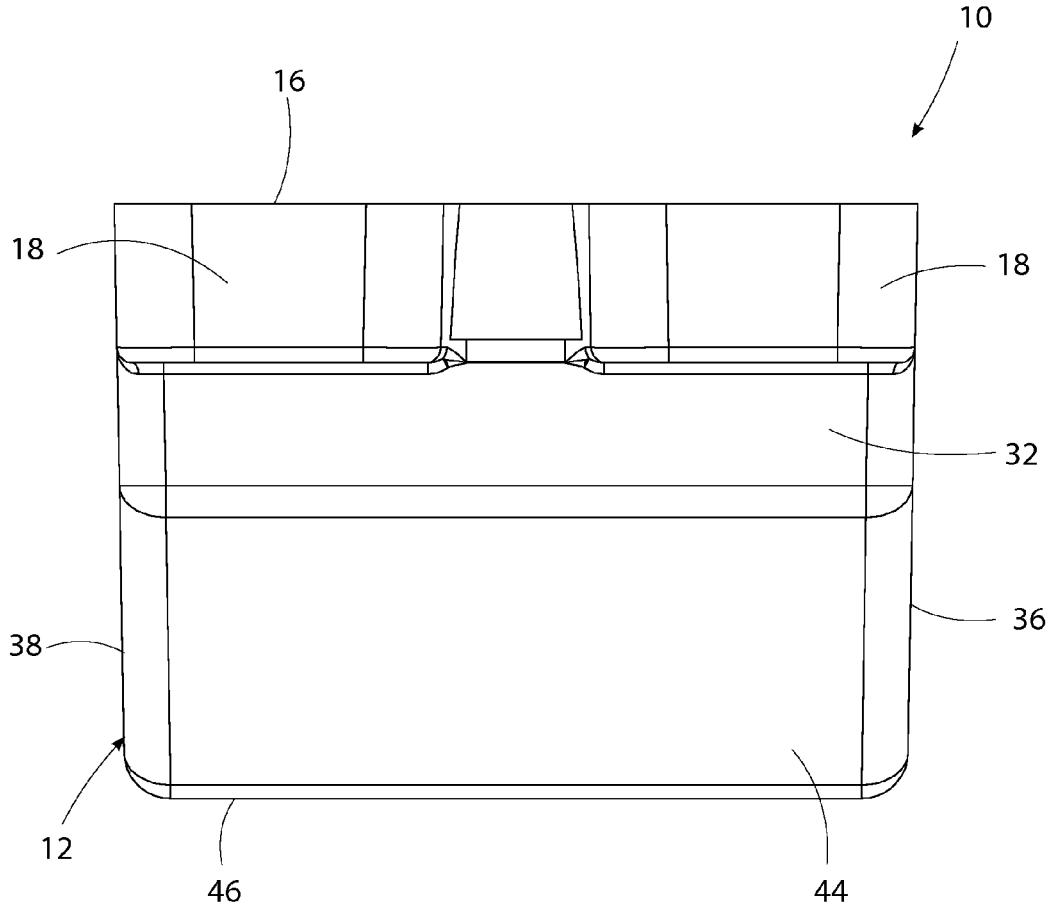
FIG. 6 is an elevation view of one end of the light assembly, with the opposite end of the light assembly being a mirror image thereof.
Figure 7:
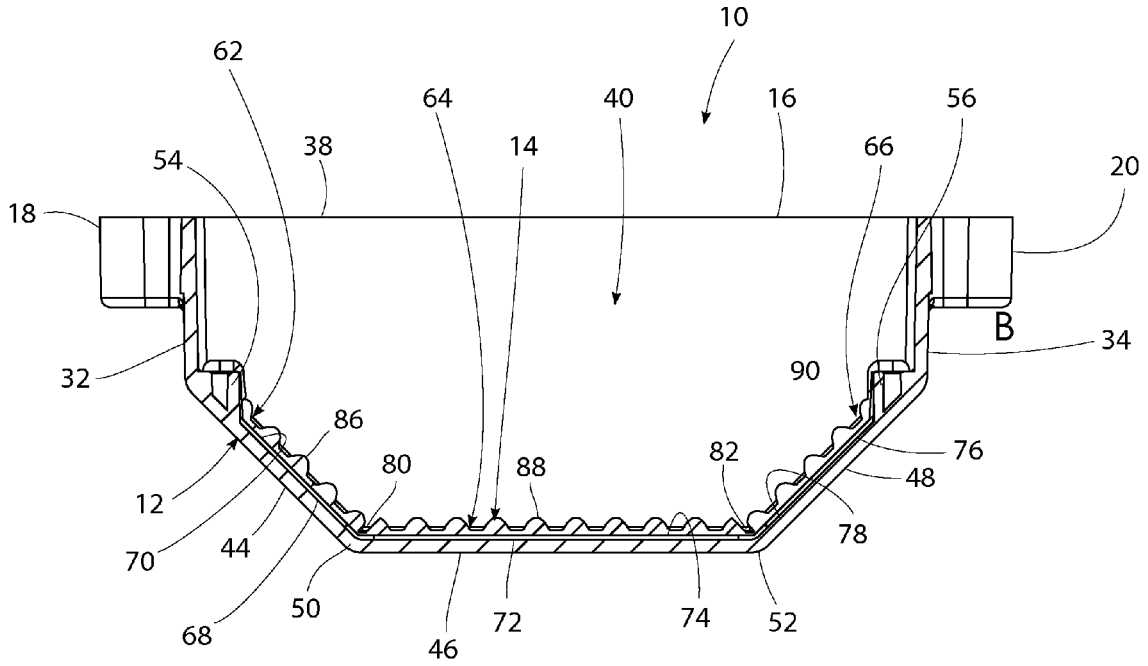
FIG. 7 is a cross-section view of the light assembly along the line 7-7 shown in FIG. 3.
Figure 8:
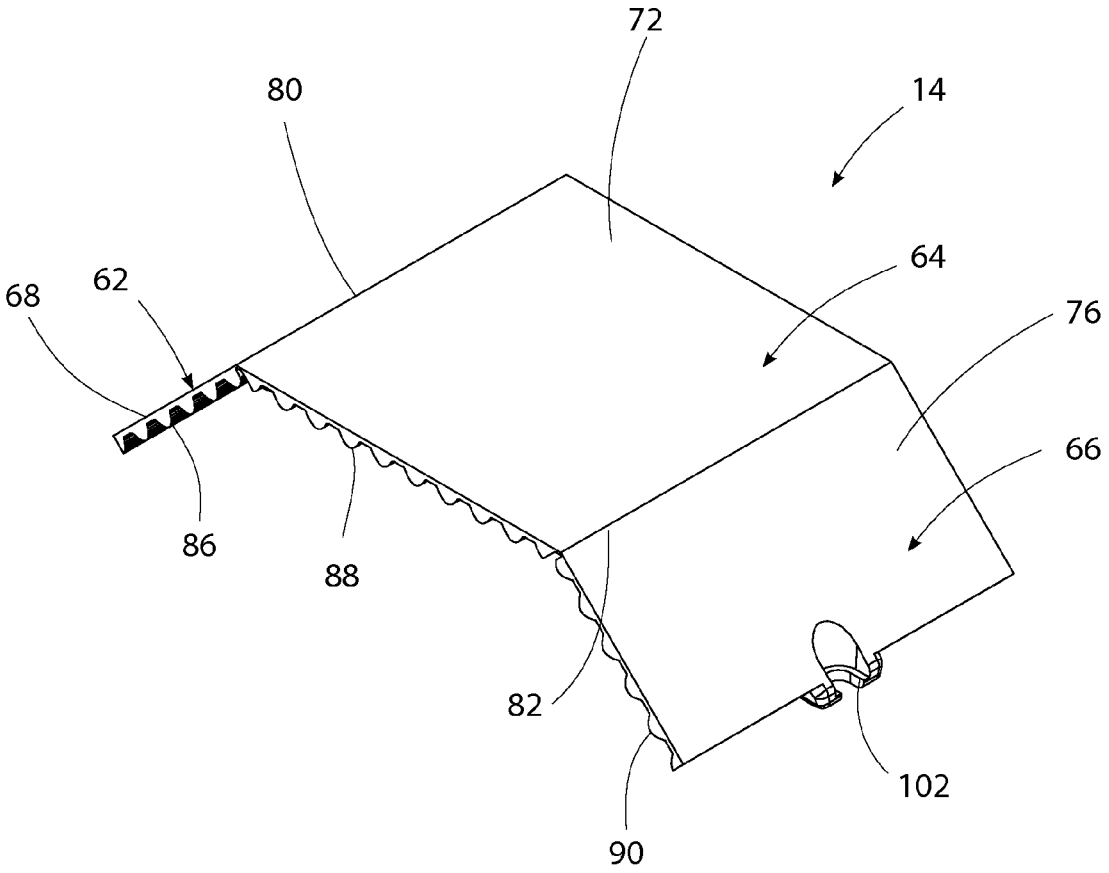
FIG. 8 is a perspective view of the lens sheet removed from the exterior, housing.
Figure 9:
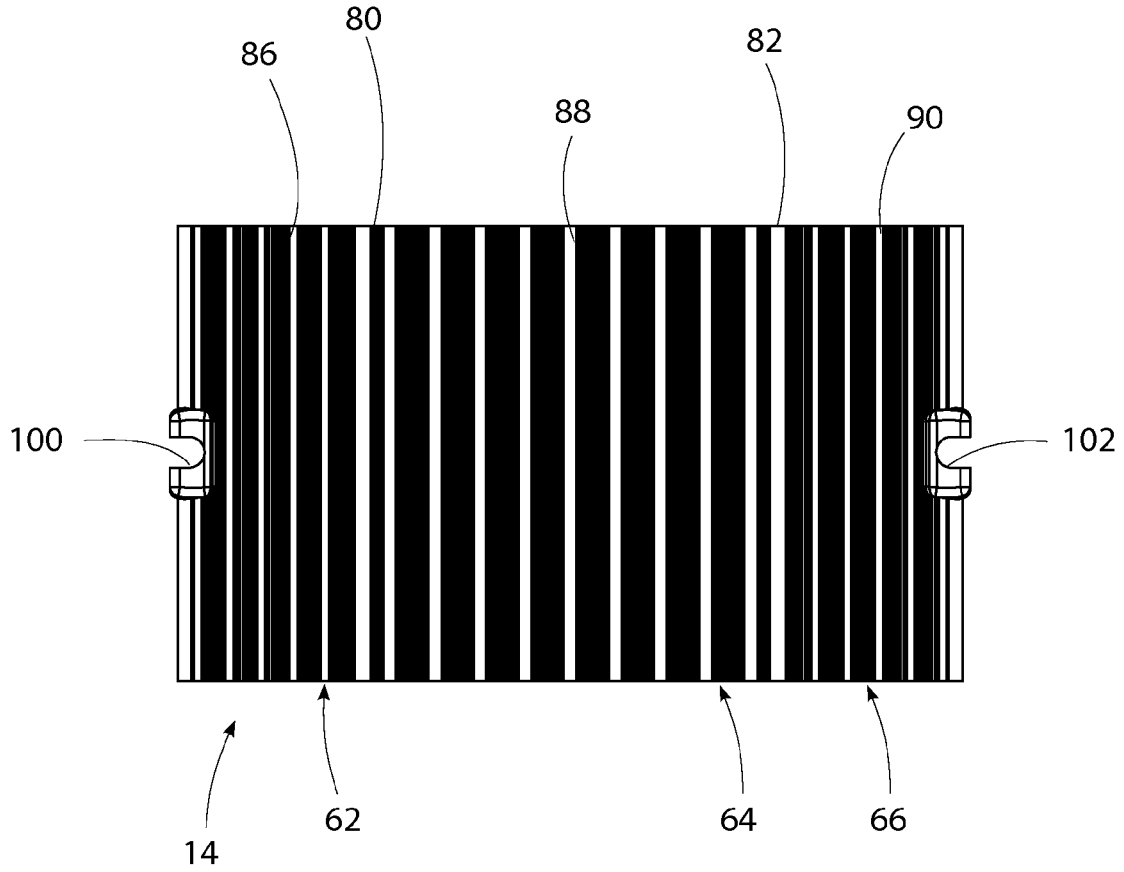
FIG. 9 is a plan view of the lens sheet.

Referring to FIG. 8, each lens sheet 14 is provided with a pair of notches 100, 102 on the outer edges of the first panel 62 and the third panel 66. The notches are centered in the opposite sides of the lens sheet 14 and are positioned to coincide with the screw bosses 54, 56 of the housing 12 when the lens sheet is assembled into the housing as shown in FIGS. 1 and 6. The notches 100, 102 of the lens sheet 14 line up with the holes of the screw bosses 54, 56. Screw threading fasteners into the screw bosses 54, 56 until they engage over the notches 100, 102 removably attaches the lens sheet 14 in the interior volume 40 of the housing 12. Removing the fasteners from the screw bosses 54, 56 enables the lens sheet 14 to be detached from the housing 12 and removed from the housing interior 40 to be replaced by a substitute lens sheet.

With the removable and interchangeable lens sheets, a single signal warning device employing the changeable light assembly 10 can be quickly configured for different applications and functions based on the inserted lens sheet 14. The device could be used as a warning signal device or a combination warning signal device and ground lighting device. By simply changing the lens sheet 14 in the housing 12 of the emergency warning light assembly 10 it is possible to change the beam pattern and beam intensity of the assembly.

As various modifications could be made in the construction of the light assembly and its method of operation herein described and illustrated without departing from the scope of the invention, it is intended that all matter contained in the foregoing description or shown in the accompanying drawings shall be interpreted as illustrative rather than limiting. Thus, the breadth and scope of the present disclosure should not be limited by any of the above described exemplary embodiments, but should be defined only in accordance with the following claims appended hereto and their equivalents.

The invention claimed is:

1. A changeable light assembly comprising:

a housing having an interior volume, the housing being attachable to a separate light source where light from the light source illuminates the housing interior volume, the housing having first and second walls oriented at a fixed angle between the first and second walls, the first and second walls being connected together along a straight line of connection between the first and second walls, the first and second walls being constructed of material that allows light to pass through the first and second walls;

a lens sheet that is molded flat, the lens sheet having first and second panels that are connected together along a straight line of connection between the first and second panels, the first and second panels being constructed of material that allows light to pass through the first and second panels, and the first and second panels being insertable into the housing interior volume with the first panel engaging against the housing first wall, the second panel engaging against the housing second wall, and the straight line of connection between the first and second panels being positioned in a same plane as the straight line of connection between the first and second walls; and, the straight line connection between the first and second panels being a molded living hinge connection.

2. The light assembly of claim 1, further comprising:

the lens sheet being removably attachable to the housing in the housing interior and the lens sheet being detachable from the housing and removable from the housing interior.

3. A changeable light assembly comprising:

a housing having an interior volume, the housing being attachable to a separate light source where light from the light source illuminates the housing interior volume, the housing having first and second walls oriented at a fixed angle between the first and second walls, the first and second walls being connected together along a straight line of connection between the first and second walls, the first and second walls being constructed of material that allows light to pass through the first and second walls;

a lens sheet that is molded flat, the lens sheet having first and second panels that are connected together along a straight line of connection between the first and second panels, the first and second panels being constructed of material that allows light to pass through the first and second panels, and the first and second panels being insertable into the housing interior volume with the first panel engaging against the housing first wall, the second panel engaging against the housing second wall, and the straight line of connection between the first and second panels being positioned in a same plane as the straight line of connection between the first and second walls;

the housing first and second walls having exterior surfaces that face away from the housing interior volume and having opposite, flat interior surfaces that face toward the housing interior volume; and, the lens sheet first and second panels having flat exterior surfaces that engage against the respective first and second wall interior surfaces and having opposite interior surfaces with refractive surface configurations.

4. The light assembly of claim 1, further comprising:

the material of the housing first and second walls being a first color; and, the material of the lens sheet first and second panels being a second color that is different from the first color.

5. The light assembly of claim 3, further comprising:

the straight line connection between the first and second panels being an attachable and detachable connection between the first and second panels.

6. A changeable light assembly comprising:

a housing having an interior volume, the housing being attachable to a separate light source where light from the light source illuminates the housing interior volume, the housing having first and second walls oriented at a fixed angle between the first and second walls, the first and second walls being connected together along a straight line of connection between the first and second walls, the first and second walls being constructed of material that allows light to pass through the first and second walls;

a lens sheet that is molded flat, the lens sheet having first and second panels that are connected together along a straight line of connection between the first and second panels, the first and second panels being constructed of material that allows light to pass through the first and second panels, and the first and second panels being insertable into the housing interior volume with the first panel engaging against the housing first wall, the second panel engaging against the housing second wall, and the straight line of connection between the first and second panels being positioned in a same plane as the straight line of connection between the first and second walls; and, the lens sheet being a single, thin sheet that has been molded flat with a living hinge along the straight line connection between the first and second panels that enables the first and second panels to be oriented at a plurality of different angles.

7. The light assembly of claim 3, further comprising:

the lens sheet first and second panels have been molded flat and separate with interconnecting edges along the straight line of connection between the first and second panels that enable the first and second panels to be interconnected at a plurality of different angles.

8. A changeable light assembly comprising:

a housing having an interior volume, the housing being attachable to a separate light source where light from the light source illuminates the housing interior volume, the housing having first and second walls that are connected together with a fixed angle between the first and second walls, the first and second walls being constructed of material that allows light to pass through the first and second walls;

a plurality of separate, interchangeable lens sheets, each of the lens sheets having first and second panels that are connected together, each of the lens sheets being constructed of material that allows light to pass through the first and second panels of the lens sheet, each of the lens sheets first and second panels having flat exterior surfaces and opposite interior surfaces with refractive surface configurations where the refractive surface configurations of the first and second panels of each lens sheet are different from the refractive surface configurations of the first and second panels of other lens sheets of the plurality of lens sheets, and each of the lens sheets being interchangeably insertable into the housing interior volume with the lens sheet first panel against the housing first wall and the lens sheet second panel against the housing second wall.

9. The light assembly of claim 8, further comprising:

each lens sheet of the plurality of lens sheets being removably attachable to the housing in the housing interior and being detachable from the housing and removable from the housing interior, thereby enabling interchanging lens sheets in the housing interior.

10. The light assembly of claim 8, further comprising:

a straight line connection between the first and second panels of each lens sheet, the connection being a molded living hinge connection.

11. The light assembly of claim 8, further comprising:

a straight line connection between the first and second panels of each lens sheet, the connection being an attachable and detachable connection between the first and second panels.

12. The light assembly of claim 8, further comprising:

the material of the housing first and second walls being a first color; and, the material of the lens sheet first and second panels being a second color that is different from the first color.

13. The light assembly of claim 8, further comprising:

each lens sheet of the plurality of lens sheets being a single, thin sheet that has been molded flat with a living hinge along a straight line connection between the first and second panels that enables the first and second panels to be oriented at a plurality of different angles.

14. The light assembly of claim 8, further comprising:

each lens sheet of the plurality of lens sheets being comprised of first and second panels that have been molded flat with interconnecting edges along a straight line connection between the first and second panels enabling the first and second panels to be interconnected at a plurality of different angles.

15. A changeable light assembly comprising:

a housing having an interior volume, the housing being attachable to a separate light source where light from the light source illuminates the housing interior volume, the housing having first, second and third planar walls, the first and second walls being connected along a first straight line of connection and oriented at a first angle, the second and third walls being connected along a second straight line of connection and oriented at the first angle, the first and second lines of connection being on opposite sides of the second wall and being parallel, the first, second and third walls being constructed of material that allows light to pass through the first, second and third walls;

a thin lens sheet having first, second and third planar panels, the first and second panels being connected along a first straight line of connection and the second and third panels being connected along a second straight line of connection, the lens sheet being constructed of material that allows light to pass through the first, second and third panels, and the lens sheet being insertable into the housing interior volume with the lens sheet first panel engaging against the housing first wall, the lens sheet second panel engaging against the housing second wall, and the lens sheet third panel engaging against the housing third wall.

16. The light assembly of claim 15, further comprising:

the lens sheet being one of a plurality of lens sheets, each lens sheet of the plurality of lens sheets being removably attachable to the housing in the housing interior and being detachable from the housing and removable from the housing interior enabling interchanging lens sheets of the plurality of lens sheets in the housing interior.

17. The light assembly of claim 15, further comprising:

the material of the housing first, second and third walls being a first color; and, the material of the lens sheet first, second and third panels being a second color that is different from the first color.

18. The light assembly of claim 15, further comprising:

the housing first, second and third walls having flat exterior surfaces that face away from the housing interior volume and opposite flat interior surfaces that face toward the housing interior volume; and, the lens sheet first, second and third panels having flat exterior surfaces that engage against the respective housing first, second and third wall interior surfaces and opposite interior surfaces with refractive surface configurations.

19. The light assembly of claim 15, further comprising:

the lens sheet being a single, thin sheet that has been molded flat with a living hinge along the first straight line of connection between the first and second panels and a living hinge along the second straight line of connection between the second and third panels enabling the first, second and third panels to be oriented at a plurality of different angles.

* * * * *